US005386173A

United States Patent [19]

Kosmatka

[11] Patent Number: 5,386,173

[45] Date of Patent: Jan. 31, 1995

[54] ONE-PIECE THERMALLY RESISTANT GIMBAL DEVICE FOR A REPLACEABLE HEADLAMP BULB

[75] Inventor: Walter J. Kosmatka, Highland Heights, Ohio

[73] Assignee: General Electric Company, Schenectady, N.Y.

[21] Appl. No.: 936,469

[22] Filed: Aug. 28, 1992

[51] Int. Cl.[6] ..... H01J 5/50

[52] U.S. Cl. ..... 313;318; 313/49; 313/51; 362/226

[58] Field of Search ..... 313/318, 49, 51, 239; 362/61, 226, 267

[56] References Cited

U.S. PATENT DOCUMENTS

| | | | |
|---|---|---|---|
| 4,626,734 | 12/1986 | Greiler | 313/318 |
| 5,039,904 | 8/1991 | Kosmatka et al. | 313/318 |
| 5,216,318 | 6/1993 | Van Dulmen et al. | 313/318 |

*Primary Examiner*—Michael Horabik
*Assistant Examiner*—Vip Patel
*Attorney, Agent, or Firm*—George E. Hawranko; Stanley C. Corwin

[57] ABSTRACT

A replaceable headlamp bulb for automotive applications comprising a discharge light source, a gimbal device, and a plastic lamp base in which the gimbal device is a one-piece construction that allows the light source to be precisely aligned and locked in a specific position with respect to the lamp base. The gimbal device is a cylindrically shaped member made of glass-mica material with a metallic ring fitted in a castellated circumferential groove at one end of the glass-mica member. The light source is mounted at the opposite end of the gimbal device to the ring-fitted portion. The plastic base contains an internal cylindrical opening into which the ring-fitted end of the glass-mica gimbal is inserted and aligned with respect to the plastic base. The gimbal device is locked inside the plastic base by heating of the metallic ring using Radio-Frequency (RF). During the RF heating the mica material reacts in the vicinity of the metallic ring which is seated inside the castellated groove to lock the gimbal to the ring. Ring sizing tolerance can be relaxed because the gaps between the castellations on each side of the groove walls serve to accommodate an oversized ring so that the ring is contained within the groove.

22 Claims, 3 Drawing Sheets

ONE-PIECE THERMALLY RESISTANT GIMBAL DEVICE FOR A REPLACEABLE HEADLAMP BULB

FIELD OF THE INVENTION

This invention relates to a replaceable automotive headlamp bulb. More particularly, the invention relates to such a replaceable bulb in which a device is provided for aligning and locking the light source in a fixed position with respect to a lamp base that is a part of the replaceable bulb.

BACKGROUND OF THE INVENTION

With automotive designs tending to lowered hood lines for better appearance of the front end of the vehicle and also better aerodynamic performance the need for smaller headlamp packaging is apparent. Smaller headlamp packaging requires smaller light bulbs which operate at higher temperatures, up to 700 degrees centigrade, due to their smaller size. These light bulbs, which are typically of the double-ended type but can be of the single-ended type, are made from quartz material. The light bulb is typically fixed onto a plastic base inside the headlamp assembly. The plastic base and the bulb mounted thereon forms a replaceable bulb. In order for the lamp to be acceptable to the average consumer, it must be cost competitive relative to other similar headlamps and must also be reliable. Therefore the replacement bulb must be of a construction with fewer parts for ease of assembly, quality and cost reasons. Proper alignment and stability of the light bulb inside the headlamp assembly are important requirements for the performance of the headlamp. The light bulb must be aligned in a specific position with respect to the plastic base. Once aligned and precisely locked in the appropriate position with respect to the plastic base, the bulb must remain in that aligned position during use, for acceptable performance of the headlamp. In fact, the lamp must conform to Federal Motor Vehicle Safety Standard 108 which defines a deflection test for replaceable headlamp bulbs. The deflection test requires that the light source must be rigidly mounted in the lamp fixture in such a manner that the bulb does not permanently deflect beyond a specified distance of 0.005 inches when a 4 pound force is applied to the bulb perpendicular to its longitudinal axis.

A gimbal device is one of the mechanisms typically used to align the light source with respect to the plastic base. The gimbal, which serves as a holder for the bulb may also be required to insulate the plastic base from the heated bulb. The gimbal is generally contained within a cylindrical opening in the plastic base from which the light bulb can be aligned, after which the gimbal is attached to the plastic base by either thermal or mechanical means so as to secure the light bulb in the aligned position.

U.S. Pat. No. 4,569,006 describes one type of gimbal device designed to align and precisely lock the light source in the aligned position while providing a system that is readily adaptable to mass production for cost reasons. While serving its intended function, this gimbal design has the disadvantage that it comprises three distinct pieces and so does not lend itself to mass production as readily as a construction with fewer pieces. In addition, the use of multiple parts/processes invariably has a negative quality impact resulting in yet additional quality costs.

U.S. Pat. No. 4,795,939 describes a gimbal device comprising two pieces, a ceramic member used as a bulb holder for a single ended quartz bulb and a plastic member that joins the ceramic bulb holder to the plastic base. The plastic member contains a groove onto which a metallic ring is fitted. The ring-fitted end of the plastic member is attached to a cylindrical opening of the plastic base by means of radio-frequency (RF) heating of the metallic ring to form a plastic-to-plastic weld. The two-piece gimbal does not easily lend itself to mass production due to the multiple parts of the gimbal.

From the standpoint of cost, quality, and ease of mass production it would be advantageous to eliminate the intermediate plastic member that connects the plastic base to the ceramic bulb holder. In this case a precise circumferential groove must be made onto the surface of the ceramic holder in order to contain the metallic ring which is heated to cause the ceramic member to be attached to the plastic base using RF energy. In order for this RF thermal attachment method to form a rigid joint, the ceramic must either deform or melt with the application of RF energy or the groove must be precisely sized to the dimensions and shape of the metallic ring.

However ceramics will not soften or melt, so that any flowing which serves to interlock the ceramic and the plastic must be done by the plastic base only. While the plastic base material could melt, there is no guarantee that the plastic base will flow into the ceramic groove and act to stabilize the joint. If the gimbal material will not flow, the joint may be stabilized by manufacturing the gimbal to such tight tolerances that the groove in the gimbal surface is very close-fitting to the metal ring contained in the groove. In this case, the joint is formed by virtue of the protrusion of the metallic ring into the softened cylindrical portion of the plastic base and the melting and flowing of the plastic around the metal. The joint is rigidified by the locking effect of the ring, protruding into the plastic wall while still within the walls of the groove.

This type of joint is dependent on the close-fitting nature of the ring and the groove. If there is any gap between the groove and the sides of the ring namely the tolerance gap, the gimbal may rock slightly, though still locked in the base. The rocking will allow the bulb to move outside the deformation limit of the federal specifications. Due to their nature, ceramic materials can not be molded to tight tolerances required for this type of fit. Ring sizing tolerance could also be tightly controlled for close-fitting of the ring into the groove, but this would be a costly option. The tapered side walls of the groove allow the tolerance gap to increase since the ring expands radially outwards as it melts into the plastic. Thus it is apparent that elimination of the tolerance gap would provide for a tighter more reliable joint. In addition, it would be particularly advantageous from a cost and quality standpoint to achieve such a tighter more reliable joint without the need to maintain a tight ring sizing tolerance.

It is the objective of this invention to provide a one-piece gimbal device with a superior gimbal device/plastic base joint for improved reliability in firmly supporting the light bulb: that contains the fewest parts possible for ease of assembly; that can be manufactured to tight tolerances to produce a high quality part; that is adaptable to mass production at a reasonable cost; and one in which the ring sizing tolerance is not critical for obtaining a rigid gimbal device/plastic joint.

SUMMARY OF THE INVENTION

The present invention provides a means for precisely locking a cylindrical glass-mica member, used as a lamp holder, to a plastic base thus providing a rigid support for the light source as well as an insulating material between the high temperature light source and the plastic base. For replaceable bulbs used in automotive applications, the light source, which operates at high temperatures, must be aligned and then rigidly held precisely in that focused position with respect to the plastic base. A one-piece glass-mica gimbal is provided for use as a holder for the light bulb, as an aid in focusing the light source, and as a means of firmly attaching the gimbal to the plastic base. Essentially, the gimbal device is a one-piece construction that allows the light source to be precisely aligned and locked in a specific position with respect to the plastic base.

In accordance with the present invention the devised means for aligning and precisely locking the light source consists of a cylindrical thermally resistant glass-mica gimbal member that is a holder for the light bulb, a metallic ring that is fitted onto a castellated groove on one end of the gimbal member, and a plastic base that contains an internal opening into which the ring-fitted gimbal device is engaged, aligned, and then firmly attached to the plastic base by thermal means. This embodiment constitutes the replaceable bulb of an automotive headlamp. The lamp holder is of a mica filled glass material that is precision manufactured to contain a castellated groove by injection molding and hence lends itself to mass production of a precision part at a reasonable cost. Upon heating, the metallic ring protrudes into the softened plastic, thus locking the metallic ring to the plastic base. As a result some free space, namely a tolerance gap, is formed between the sides of the groove and the metallic ring. The mica filled glass material is desirable because when the metallic ring is heated the mica particles expand or bloat in the vicinity of the metallic ring to fill up the tolerance gap between the sides of the groove and the ring, thus locking the gimbal member to the metallic ring. The alternating castellations in the ring-containing groove of the glass-mica holder will serve to accommodate an oversized ring inside the groove. The oversized ring will fit inside the groove in such a manner that upon heating its outward radial expansion will not result in a substantial increase in the tolerance gap so as to cause an unreliable joint. Hence the ring sizing tolerance can be relaxed while still eliminating the tolerance gap to obtain a locking effect between the sides of the groove and the metallic ring. The mica filled glass material is desirable for this application because of its bloating characteristic, high temperature resistance, low thermal conductivity, and ease of manufacturability of the castellated lamp holder to tight tolerances.

The glass-mica bulb holder provides for a reliable gimbal/plastic joint and a high quality part manufacturable by mass production at a reasonable cost. The glass-mica material has a bloating characteristic which causes it to eliminate the tolerance gap between the groove and the ring thus ensuring a tight, reliable joint. The glass-mica material can also be precision molded to contain alternating castellations in the groove so that the ring sizing tolerance is not critical to achieving a tight fit. The one-piece ceramic gimbal also reduces the number of parts in the replaceable bulb assembly thus contributing to lower overall cost and higher quality of the headlamp.

BRIEF DESCRIPTION Of THE DRAWINGS

In the following detailed description of the invention reference will be made to the attached drawings in which.

DETAILED DESCRIPTION OF THE INVENTION

FIG. I is a side view of one embodiment 10 of the present invention illustrating the light source 12, the one-piece glass-mica gimbal device 14, and the plastic base 16. The presented embodiment constitutes a replaceable bulb of an automotive headlamp. Thus a new bulb is replaced by installing into the headlamp fixture the preferred embodiment of FIG. 1 in a manner that is standard for a replaceable headlamp bulb of this type. Once installed in the fixture the assembly must conform to Federal Motor Vehicle Safety Standard 108. The standard demands that the replaceable bulb mounted inside the lamp fixture should not deflect beyond a specified distance of 0.005 inches in response to a 4 pound force applied perpendicular to its longitudinal axis. A tight reliable joint between the one-piece gimbal device 14 and the plastic base 16 is critical to ensure that the lamp meets the deflection specification.

Figure 1:
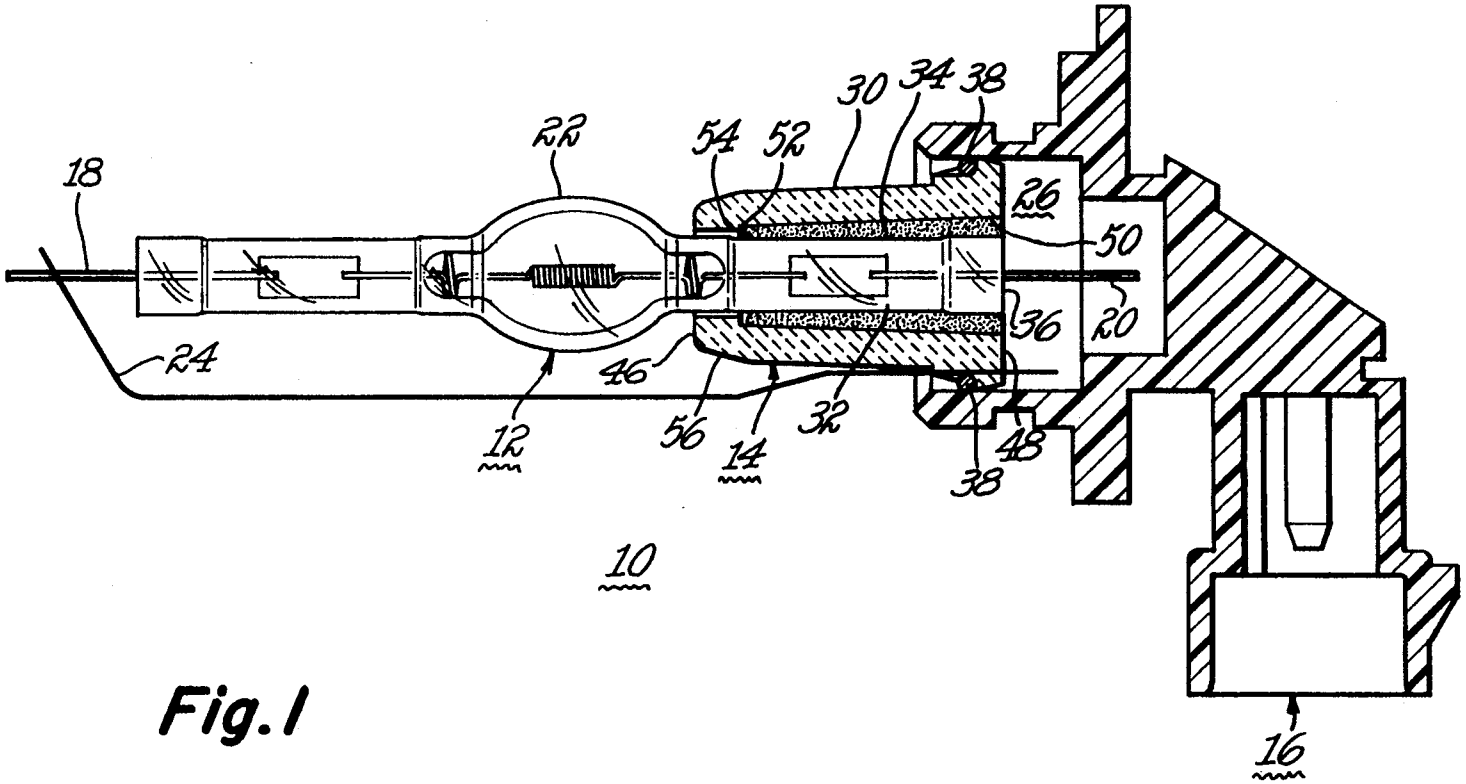
FIG. 1 is an elevational view in section of one embodiment of the present invention illustrating the ring-fitted gimbal, the light source, and the plastic base.

The high temperature light source 12 shown in FIG. 1 is of the double-ended type, made of quartz material, and having a pair of lead wires 18 and 20 emerging from the neck sections on either side of the bulbous portion 22 of the light source 12. The outer lead wire 18 is connected to an external lead wire 24 that is directed into the internal opening 26 in the plastic base 16 via an axial groove 28 in the side of the glass-mica lamp holder 30 of FIG. 4. The inner lead 20 terminates in the internal opening 26 of the plastic base 16, whereupon both leads 18 and 20 can be connected to the terminals of a conventional electrical source using well known means. The neck section 32 of the light source 12 that encapsulates the inner lead wire 20 is held in the internal opening 34 of the glass-mica lamp holder 30 in such a manner that the ceramic cement within the internal opening 34 provides support for the neck section 32 of the light source 12. The end tip 36 of the supported neck section 32 of the light source 12 extends into the opening 34 of the glass-mica lamp holder 30 so that it is approximately in the same plane as the ring-fitted end opening 48 of the lamp holder 30.

The plastic base 16, constructed from a high temperature plastic, is shown in FIG. 1 containing a cylindrical internal opening 26 into which the ring-fitted end of the gimbal device 14 is engaged. The plastic base 16 is of a configuration that it can be mounted into the headlamp fixture in a manner that is consistent with industry practice.

Figure 2:
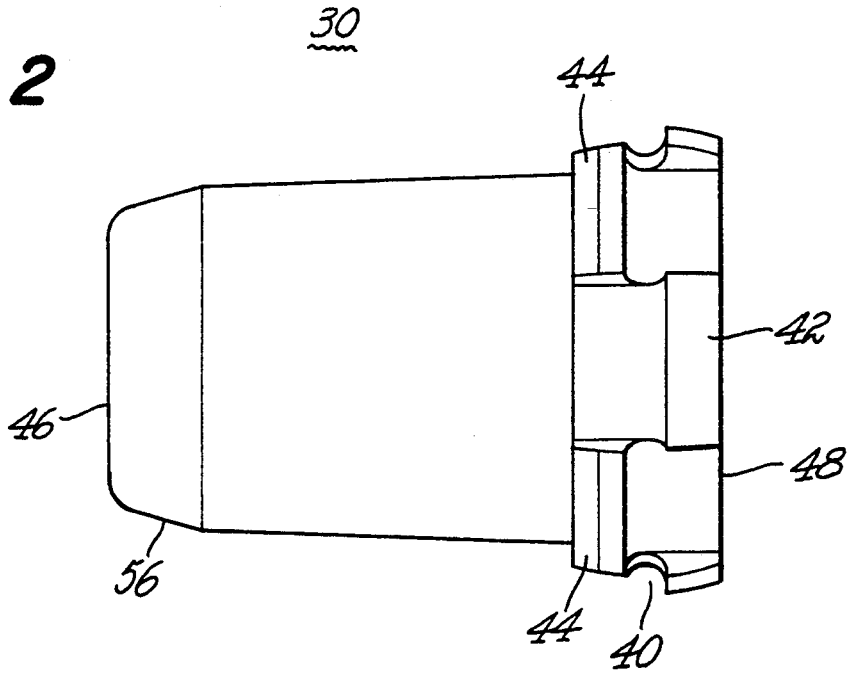
FIG. 2 is a side view of the glass-mica lamp holder showing the tapered end and the castellated groove.
Figure 3:
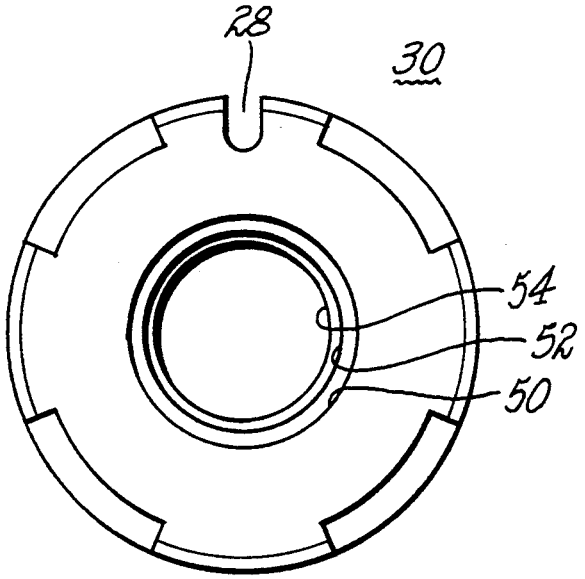
FIG. 3 is a front view of the glass-mica lamp holder showing the alternating castellations on either side of the groove opening and an axial groove for the external lead wire.
Figure 4:
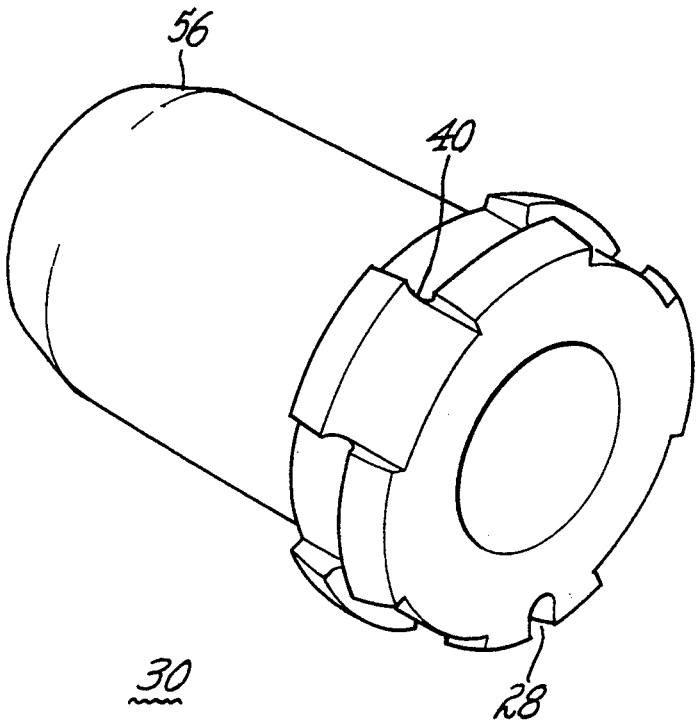
FIG. 4 is a 3-dimensional side view of the glass-mica lamp holder showing the tapered end, the castellations on either side of the groove opening, and the axial groove for the external lead wire, in accordance with the present invention.

The gimbal device 14 of FIG. 1 comprises the glass-mica lamp holder 30 with a circumferential metallic ring 38 that is contained within a castellated groove 40 at one end of the bulb holder 30. The lamp holder 30 of FIG. 1, FIG. 2, and FIG. 4 is tapered at the end opposite the ring-fitted end so that the edges around the circumference of the holder at this end are smoothed out. The lamp holder 30 is of a mica based glass material manufacturable to contain a castellated groove 40 and an axial groove 28 through the castellated groove of the holder 30 by injection molding. The metallic ring 38 is contained within an alternating castellated groove 40 extending around the full circumference of the holder 30 where the opposite sides or walls of the groove that support the fitted ring are discontinuous in such a manner that resembles the top of a castle. Furthermore, the discontinuities in the walls or the castellations alternate on either sides of the groove 40 along the full circumference of the lamp holder 30. FIG. 2 is a side view of the lamp holder showing a top view of alternating castellations 42 and 44 on either sides of the groove 40. FIG. 4 shows the castellations from a 3-dimensional view. The slot 28 of FIG. 3 and FIG. 4 is designed to accommodate the external lead wire 24 used to complete the electrical circuit of the lamp, in accordance with the embodiment of the present invention shown in FIG. 1.

As seen in FIG. 1 the lamp holder 30 contains an internal opening 34 extending from the tapered end 46 to the ring-fitted end 48 of the gimbal 14. FIG. 1 shows that the size of the opening is largest at the ring-fitted end 48 of the gimbal 14 and gets progressively smaller towards the tapered end 46 of the gimbal 14. FIG. 3 is a section of the lamp holder viewed from the ring-fitted end 48 of the gimbal 14 illustrating the changes in diameter of the internal opening 34 of the glass-mica gimbal 14 towards the tapered end 46 as represented by the concentric circles 50, 52 and 54 of FIG. 3. The outer circle 50 represents the diameter of the opening at the ring-fitted end 48, the middle circle 52 is the diameter of the internal opening 34 at the beginning 52 of the tapered section 56 of the gimbal 14 and the minimum inside diameter 54 of the internal opening 34 at the tapered section 56 of the gimbal 14 is represented by the inner circle 54. The tapered section 56 at the end of the gimbal 14 onto which the light source 12 is mounted is tapered not only for appearance purposes but also to prevent the gimbal 14 from blocking light emitted from the bulbous portion 22 of the light source 12 in accordance with the embodiment of the present invention disclosed in FIG. 1. The internal opening 34 of the gimbal 14 is made considerably smaller at the tapered section 56 of the gimbal 14 so that it is of a suitable diameter to contain the ceramic cement used to support the neck section 32 of the light source 12 that is inserted into it, as is illustrated in FIG. 1.

The ring-fitted end 48 of the gimbal 14 is inserted into the opening 26 of the plastic base so that the inside walls of the internal opening 26 of the plastic base 16 are in contact with the metallic ring 38 and/or the spherically shaped outer surfaces 42 and 44 of FIG. 2 on either sides of the groove 40, as illustrated in FIG. 1. Such a configuration, shown in FIG. 1, gives the gimbal device 14 the freedom to slide axially in one plane and to rotate about the center of the spherically shaped outer surface of the castellations in the other two planes thus enabling the light source 12 to be focused with respect to the plastic base 16. Once the light source 12 is focused with respect to the plastic base 16 the metallic ring 38 in the gimbal/-plastic joint is heated by application of Radio-Frequency (RF) energy whereupon the heat causes softening of the plastic walls and protrusion of the metallic ring 38 into the softened plastic base 16; and expansion of the gimbal material in the groove 40 thus interlocking the lamp holder to the plastic base. Upon heating of the gimbal 14 to high temperatures via the metallic ring 38, the mica particles in the glass-mica gimbal 14 expand or "bloat" only in the groove 40 material in the vicinity of the ring 38 and fill up any voids next to the sides of the ring 38 so as to form a tighter joint. In order to form a tight joint which is required for a stable and reliable support of the light source 12, any gap between the sides of the groove 40 and the ring 38 must be eliminated. Without correction, this tolerance gap between the sides of the groove 40 and the ring 38 which is due to the manufacturing tolerance of the groove 40 would result in apparent looseness of the plastic/gimbal joint and hence deflection of the light source 12 from the focused position outside the tolerance specified by Federal requirements.

Generally in order to form a rigid fit at the plastic/-gimbal interface employing the RF method of attachment, both the gimbal material and the plastic must melt and flow to fill the tolerance gap between the sides of the groove and the ring, or alternatively the ring must fit perfectly into the groove thereby eliminating the same tolerance gap. However, ceramics do not melt and flow. Furthermore, conventional ceramics can not be molded to the tight tolerances required for this type of fit. Ring sizing tolerance can be controlled to the level required to eliminate the tolerance gap but at a cost. Hence the bloating characteristic of the glass-mica material provides for a way to eliminate the tolerance gap problem in a cost effective way. An additional advantage of the glass-mica material is it can be precision manufactured to contain the castellated groove by injection molding and so the part lends itself to mass production at a reasonable cost. Since the groove walls alternate on either side of the groove, ring tolerance can be relaxed, because the gaps between the walls serve to accommodate the ring inside the castellated groove opening. Without the castellations in the groove, an oversized ring will significantly expand radially to increase the tolerance gap between the sides of the groove and the ring. In the extreme case the ring may expand outside the groove leaving no opportunity to achieve the locking effect between the sides of the groove and the ring. A glass material would be unsuitable for this application since it can not be machined to contain the castellations.

The two-piece gimbal disclosed in U.S. Pat. No. 4,795,939 contains an extra plastic member between the ceramic lamp holder and the plastic base. This member contains a circumferential groove and a metallic ring disposed therein for attaching the plastic member to the plastic base. The joint in this case is formed by virtue of the melting and/or co-mixing of the plastics from the base and the ring containing member. During the RF heating process the metallic ring expands radially into the plastic base thus locking the metallic ring to the plastic base. In the case of an oversized ring, such radial expansion will result in a substantial increase in the tolerance gap. To obtain a firm and reliable weld the presence of voids in the joint must be minimal. However there is no way to ensure that the plastics melt and flow in such a manner that the gaps in the joint are eliminated during the RF heating process. Hence the joint may not always be reliable. Ring sizing tolerance may be tightly controlled to alleviate the tolerance gap problem, but this is costly and still does not ensure that all voids are eliminated. The additional plastic part naturally adds to the total number of parts and the complexity of the assembly process which may have a negative impact on the overall quality and cost of the product. Some benefits of a simplified design with fewer parts includes cost, quality, and ease of manufacturing by mass production.

The provided glass-mica gimbal is heat resistant and so maintains its structural integrity under the intense heat of the RF ring and the light source with which it is in contact. It also possesses a low thermal conductivity in order to insulate the plastic base from the heated bulb. High temperature plastics are both too costly and do not possess the thermal stability required at high temperatures to be used in place of the ceramics or glass. Due to their lack of thermal stability, plastics may exhibit outgassing at elevated temperatures to produce a condensable vapor that can affect the appearance of color output from the lamp if deposited on glass. On the other hand, a metallic gimbal would result in overheating of the plastic base due to the high heat transfer characteristics inherent in metals. The present invention has the added benefits that it can be used for any high temperature light source such as discharge and halogen IR, single-ended or double-ended bulbs with the appropriate modifications, and does not require that the gimbal be capable of melting or be made of polymeric materials in order to use the RF attachment method. In addition the gimbal device presented in this invention consists of a one-piece construction of the high temperature glass-mica holding mechanism and gimbal/ring attachment portion of the holder which makes it superior to prior art since multiple parts constructions invariably have a negative effect on quality, cost, and ease of mass production.

Although the hereinabove described embodiment of the present invention constitutes a preferred embodiment of the invention, it should be understood that modifications can be made thereto without departing from the scope of the invention as set forth in the appended claims. For instance, with regards to the RF metallic ring, instead of a single ring, it may be possible to use alternate configurations such as a series of two or more segments of a ring contained within the groove. In this case RF energy could be employed to each segment of the ring separately to achieve the desired locking effect between the gimbal and the lamp base that is described in this specification.

What we claim as new and desire to secure by the Letters Patent of the United States is:

1. A lamp and mounting arrangement thereof for achieving precise alignment of the lamp comprising, a light source;

a lamp holder wherein said light source is mounted, said lamp holder being constructed in a one-piece configuration of a high temperature resistant and insulating material;

a lamp base with an internal opening wherein said lamp holder is engaged and through which energy for energizing the light source is introduced;

wherein said lamp holder and said light source are movable within said internal opening of said lamp base during an alignment stage to achieve such precise alignment of said light source with respect to said lamp base;

means for receiving electrical energy and generating heat in a uniform manner around the periphery of a portion of said lamp holder, said portion of said lamp holder being engaged inside the internal opening of said lamp base, thereby locking said lamp holder rigidly to said lamp base; and wherein said material of said one-piece lamp holder includes mica, such that following alignment, by introduction of electrical energy to said electrical energy receiving means, the mica material reacts to lock said lamp holder in place.

2. A lamp and mounting arrangement according to claim 1 wherein, said light source includes an envelope having a filament structure therein and at least two lead wires projecting from said envelope.

3. A lamp and mounting arrangement according to claim 1 wherein, said light source is of a double-ended type and includes an envelope made of a quartz material.

4. A lamp and mounting arrangement according to claim 1 wherein, said lamp holder is cylindrically shaped with a cylindrical opening through which a portion of an envelope associated with said light source is inserted.

5. A lamp and mounting arrangement according to claim 4 wherein, said cylindrical opening of said lamp holder contains a ceramic cement to provide support for said portion of said envelope inserted therein.

6. A lamp and mounting arrangement according to claim 4 wherein, said cylindrical opening of said lamp holder is smaller towards an end of said lamp holder where said envelope is inserted, in comparison to another end of said lamp holder, said smaller opening being of a suitable diameter to contain the ceramic cement used to support said envelope inside said cylindrical opening of said lamp holder.

7. A lamp and mounting arrangement according to claim 1 wherein, the circumferential external edge of said lamp holder where an envelope associated with said light source is inserted, is tapered and smoothed so as to avoid blocking light emitted from a bulbous portion of said envelope.

8. A lamp and mounting arrangement according to claim 1 wherein, said periphery of said portion of said lamp holder in contact with the walls of said internal opening of said lamp base is spherically shaped and smoothed so as to allow said lamp holder the freedom to move inside said lamp base, thereby aligning said light source.

9. A lamp and mounting arrangement according to claim 1 wherein, said periphery of said portion of said lamp holder is a circumferential groove in the region of fitting and seating engagement with said lamp base.

10. A lamp and mounting arrangement according to claim 1 wherein, said electrical energy receiving means is a metallic ring fitted in a groove formed in said lamp holder, said metallic ring being energized by a radio-frequency (RF) source to generate heat.

11. A lamp and mounting arrangement according to claim 1 wherein, said lamp base is of a plastic material that softens upon generation of heat by said electrical energy receiving means to lock the plastic material to said electrical energy receiving means and a portion of said lamp holder.

12. A lamp and mounting arrangement according to claim 1 further comprising means for connecting one of a pair of lead wires projecting from an envelope associated with said light source to said electrical energy for energizing said light source wherein said lamp holder contains an axial groove along its longitudinal axis, and said one lead is disposed therein to complete the electrical circuit for the lamp.

13. A lamp and mounting arrangement according to claim 1 wherein said light source is a high temperature light source including discharge and halogen IR, single-ended or double-ended bulbs.

14. A lamp and mounting arrangement thereof for achieving precise alignment of the lamp comprising:

a light source;

a lamp holder wherein said light source is mounted, said lamp holder being constructed of a thermally resistant and insulating material;

a lamp base with an internal opening wherein said lamp holder is engaged and through which energy for energizing the light source is introduced;

wherein said lamp holder and said light source are movable within said internal opening of said lamp base during an alignment stage to achieve such precise alignment of said light source with respect to said lamp base;

means for receiving electrical energy and generating heat in a uniform manner around the periphery of a portion of said lamp holder, said portion of said lamp holder being engaged inside the internal opening of said lamp base, thereby locking said lamp holder firmly to said lamp base; and wherein said lamp holder is formed with a circumferential groove in the region of fitting and seating engagement with said lamp base, wherein said groove has alternating castellations in the walls of the groove, wherein said alternating castellations form gaps which accommodate said electrical energy receiving means inside the walls formed in said groove.

15. A lamp and mounting arrangement according to claim 14 wherein, said lamp holder is cylindrically shaped with a cylindrical opening through which a portion of an envelope associated with said light source is inserted.

16. A lamp and mounting arrangement according to claim 15 wherein, said cylindrical opening of said lamp holder is smaller towards an end of said lamp holder where said envelope is inserted, in comparison to another end of said lamp holder, said smaller opening being of a suitable diameter to contain the ceramic cement used to support said envelope inside said cylindrical opening of said lamp holder.

17. A lamp and mounting arrangement according to claim 14 wherein, the circumferential external edge of said lamp holder where an envelope associated with said light source is inserted, is tapered and smoothed so as to avoid blocking light emitted from a bulbous portion of said envelope.

18. A lamp and mounting arrangement according to claim 14 wherein, said periphery of said portion of said lamp holder in contact with the walls of said internal opening of said lamp base is spherically shaped and smoothed so as to allow said lamp holder the freedom to move inside said lamp base, thereby aligning said light source.

19. A lamp and mounting arrangement according to claim 14 wherein, said electrical energy receiving means is a metallic ring contained in said castellated groove formed in said lamp holder, said metallic ring being energized by a radio-frequency (RF) source to generate heat.

20. A lamp and mounting arrangement according to claim 14 wherein, said lamp base is of a plastic material that softens upon generation of heat by said electrical energy receiving means to lock the plastic material to said electrical energy receiving means and a portion of said lamp holder.

21. A lamp and mounting arrangement according to claim 14 further comprising means for connecting one of a pair of lead wires projecting from an envelope associated with said light source to said energy for energizing said light source wherein said lamp holder contains an axial groove along its longitudinal axis, and said one lead is disposed therein to complete the electrical circuit for the lamp.

22. A lamp and mounting arrangement according to claim 14 wherein said lamp holder is constructed in a one-piece configuration.

* * * * *